US010478983B2

(12) United States Patent
Yang et al.

(10) Patent No.: US 10,478,983 B2
(45) Date of Patent: Nov. 19, 2019

(54) SNAP-OFF DOUBLE-EDGED RAZOR BLADE

(71) Applicant: DORCO CO,. LTD., Seoul (KR)

(72) Inventors: Hee Sung Yang, Yongin-si (KR); Jae Young Lee, Yongin-si (KR); Hyun Ju Lee, Yongin-si (KR)

(73) Assignee: DORCO CO,. LTD., Seoul (KR)

( * ) Notice: Subject to any disclaimer, the term of this patent is extended or adjusted under 35 U.S.C. 154(b) by 0 days.

(21) Appl. No.: 15/918,676

(22) Filed: Mar. 12, 2018

(65) Prior Publication Data

US 2018/0200902 A1 Jul. 19, 2018

Related U.S. Application Data

(63) Continuation of application No. PCT/KR2015/012693, filed on Nov. 25, 2015.

(30) Foreign Application Priority Data

Sep. 15, 2015 (KR) ..... 10-2015-0130046

(51) Int. Cl.
*B26B 21/56* (2006.01)
*B26B 21/10* (2006.01)
*B26B 21/40* (2006.01)

(52) U.S. Cl.
CPC ..... *B26B 21/56* (2013.01); *B26B 21/10* (2013.01); *B26B 21/4012* (2013.01)

(58) Field of Classification Search
CPC ..... B26B 21/00; B26B 21/4006; B26B 21/54; B26B 21/56; B26B 21/565
(Continued)

(56) References Cited

U.S. PATENT DOCUMENTS 1,734,554 A 11/1929 Behrman
1,974,568 A * 9/1934 Grotenhuis ..... B26B 21/00 30/27
(Continued)

FOREIGN PATENT DOCUMENTS

CN 2792731 7/2006
CN 201030559 3/2008
(Continued)

OTHER PUBLICATIONS

International Search Report issued for corresponding International Patent Application No. PCT/KR2015/012693, dated Apr. 26, 2016. English translation attached.
(Continued)

*Primary Examiner* — Andrea L Wellington
*Assistant Examiner* — Richard D Crosby, Jr.
(74) *Attorney, Agent, or Firm* — Lee, Hong, Degerman, Kang & Waimey PC

(57) ABSTRACT

A double-edged razor blade including: a first unit blade having a first cutting edge; a second unit blade having a second cutting edge; a first connecting portion connecting one side of the first unit blade with one side of the second unit blade; a second connecting portion connecting the other side of the first unit blade with the other side of the second unit blade; a pair of first notches forming a boundary between the first unit blade and the first and the second connecting portions, and guiding breakage of the first unit blade; and a pair of second notches forming a boundary between the second unit blade and the first and the second connecting portions, guiding breakage of the second unit blade.

7 Claims, 7 Drawing Sheets

(58) Field of Classification Search
USPC ..... 30/346–346.57
See application file for complete search history.

(56) References Cited

U.S. PATENT DOCUMENTS 2,035,110 A * 3/1936 Becker ..... B26B 21/56 30/346.57
2,041,778 A * 5/1936 Peters ..... B26B 21/56 30/346.56
2,287,549 A * 6/1942 Carlson ..... B26B 21/56 30/346.53
2,361,921 A * 11/1944 Albert ..... B26B 21/00 30/50
2,364,236 A 12/1944 Muros
2,413,863 A * 1/1947 Connolly ..... B26B 21/56 30/346.61
2,453,198 A * 11/1948 Corbett ..... B26B 5/006 30/169
2,582,913 A * 1/1952 Pfefferle ..... B26B 21/56 30/346.53
2,637,904 A * 5/1953 Springer ..... B26B 27/00 30/334
2,657,460 A 11/1953 Cerino et al.
2,787,831 A * 4/1957 Siegel ..... B26B 21/28 30/346.55
3,071,858 A * 1/1963 Alter ..... B05D 5/08 30/346.53
3,276,121 A * 10/1966 Larson ..... B26B 21/34 30/346
3,448,518 A * 6/1969 Sklar ..... B26B 5/002 30/162
3,664,020 A * 5/1972 Hammond ..... A47G 21/02 132/323
4,125,939 A * 11/1978 Brothers ..... B26B 21/22 30/50
D254,229 S * 2/1980 Julius ..... D7/643
4,240,202 A * 12/1980 Gilbert ..... B26B 5/002 30/162
4,441,253 A * 4/1984 Sacks ..... B26B 21/18 30/32
4,489,627 A * 12/1984 Lembke ..... B26B 21/54 76/104.1
4,562,645 A * 1/1986 Dato ..... B26B 21/4068 30/346.58
4,887,356 A * 12/1989 Rudd, Sr. ..... B26B 21/10 30/30
5,103,564 A * 4/1992 MacDonald ..... B26B 9/00 30/346.61
5,624,451 A * 4/1997 Segal ..... A61B 17/32093 30/346.5
5,687,485 A 11/1997 Shurtleff et al.
5,761,814 A 6/1998 Anderson et al.
5,934,291 A * 8/1999 Andrews ..... A45D 24/36 132/215
5,956,848 A 9/1999 Tseng et al.
5,956,851 A 9/1999 Apprille et al.
6,041,926 A 3/2000 Petricca et al.
6,052,903 A 4/2000 Metcalf et al.
6,185,822 B1 2/2001 Tseng et al.
6,212,777 B1 4/2001 Gilder et al.
6,226,873 B1 * 5/2001 Okumura ..... B26B 5/002 30/162
6,442,839 B1 9/2002 Tseng et al.
6,516,518 B1 2/2003 Garraway et al.
6,612,040 B2 9/2003 Gilder
6,684,513 B1 2/2004 Clipstone et al.
6,823,593 B2 * 11/2004 Dunn-Rankin ..... B26B 9/02 30/346.56
6,895,674 B2 * 5/2005 Ai ..... B26B 9/00 30/162
6,938,345 B2 * 9/2005 Yu ..... B23D 61/12 30/122
D580,241 S * 11/2008 Fraga ..... D8/20
D617,161 S * 6/2010 Tom ..... D8/20
D617,162 S * 6/2010 Tom ..... D8/20
D619,865 S * 7/2010 Boehler ..... D8/20
8,162,784 B1 * 4/2012 Bellefeuille ..... F42B 6/08 124/20.3
8,726,520 B1 * 5/2014 Abraham ..... B26B 21/4081 30/32
8,739,412 B2 * 6/2014 Gioia ..... B26B 5/00 30/123
9,009,981 B2 * 4/2015 Quimby ..... G03F 1/00 30/351
9,884,380 B2 * 2/2018 Muti ..... B23D 49/10
2005/0050734 A1 * 3/2005 Kesinger ..... B26B 5/002 30/162
2007/0245574 A1 * 10/2007 Green ..... B26B 9/00 30/346.5
2009/0064507 A1 * 3/2009 Green ..... B26B 9/00 30/339
2010/0071216 A1 * 3/2010 Novak ..... B26B 9/00 30/162
2010/0107417 A1 * 5/2010 Crisp ..... A46B 15/0055 30/122
2011/0130678 A1 * 6/2011 Williamson, IV ..... A61B 17/3205 600/564
2012/0103356 A1 * 5/2012 Crisp ..... A46B 15/0055 132/200
2013/0047447 A1 * 2/2013 Fossella ..... B26B 5/00 30/351
2015/0360375 A1 * 12/2015 Wertz ..... B26B 21/18 30/52
2016/0039104 A1 * 2/2016 Tong ..... B26B 21/22 30/346.61
2018/0200902 A1 * 7/2018 Yang ..... B26B 21/40

FOREIGN PATENT DOCUMENTS

| | | |
|---|---|---|
| DE | 538964 | 11/1931 |
| DE | 1553830 | 6/1971 |
| GB | 751357 | 6/1956 |
| JP | S57-160490 | 10/1982 |
| KR | 10-1983-0007239 A | 10/1983 |
| KR | 830007239 | 10/1983 |
| KR | 20-1988-0009600 U | 7/1988 |
| KR | 20-1992-0007664 Y1 | 10/1992 |
| KR | 10-2015-0079970 A | 7/2015 |
| RU | 2051024 | 12/1995 |

OTHER PUBLICATIONS

Russian Federation Federal Service for Intellectual Property, Patents and Trademarks Application No. 2018113449/02, Office Action dated Dec. 11, 2018, 4 pages.
Russian Federation Federal Service for Intellectual Property, Patents and Trademarks Application No. 2018113449/02, Search Report dated Nov. 1, 2018, 2 pages.
The State Intellectual Property Office of the People's Republic of China Application Serial No. 201580083134.7, Office Action dated Dec. 25, 2018, 4 pages.
Japan Patent Office Application No. 2018-533587, Office Action dated Jan. 15, 2019, 3 pages.
European Patent Office Application Serial No. 15904200.1, Search Report dated Apr. 10, 2019, 6 pages.

* cited by examiner

【FIG. 1】
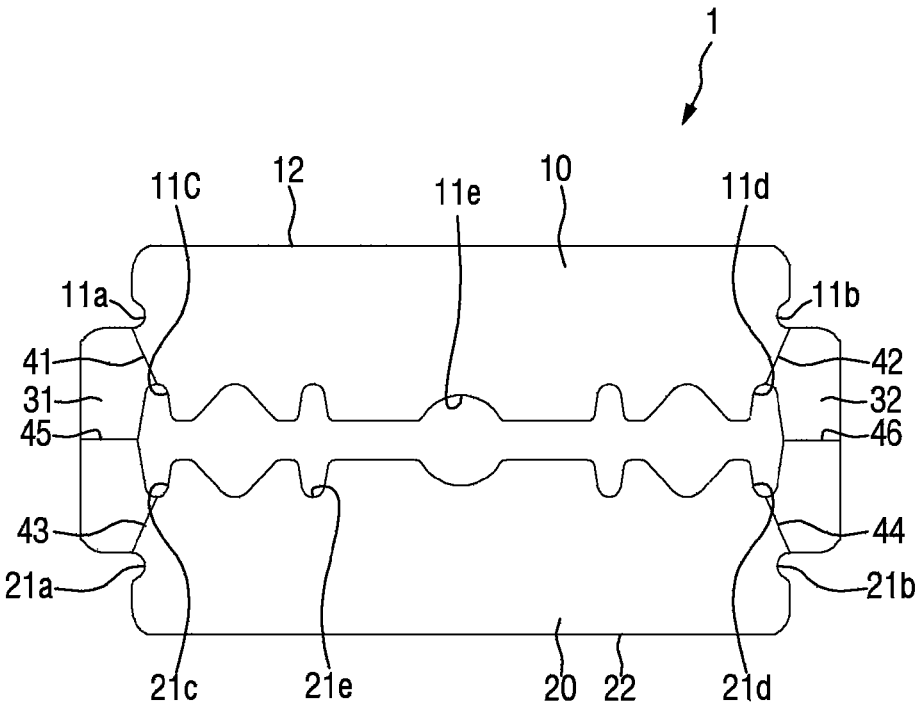

【FIG. 2】
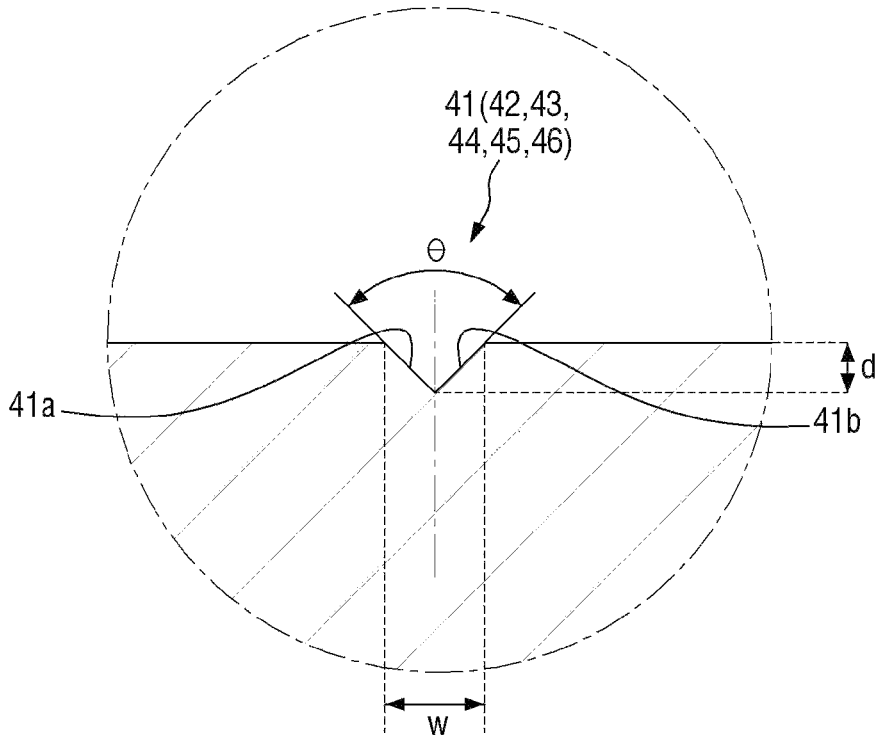

【FIG. 3】
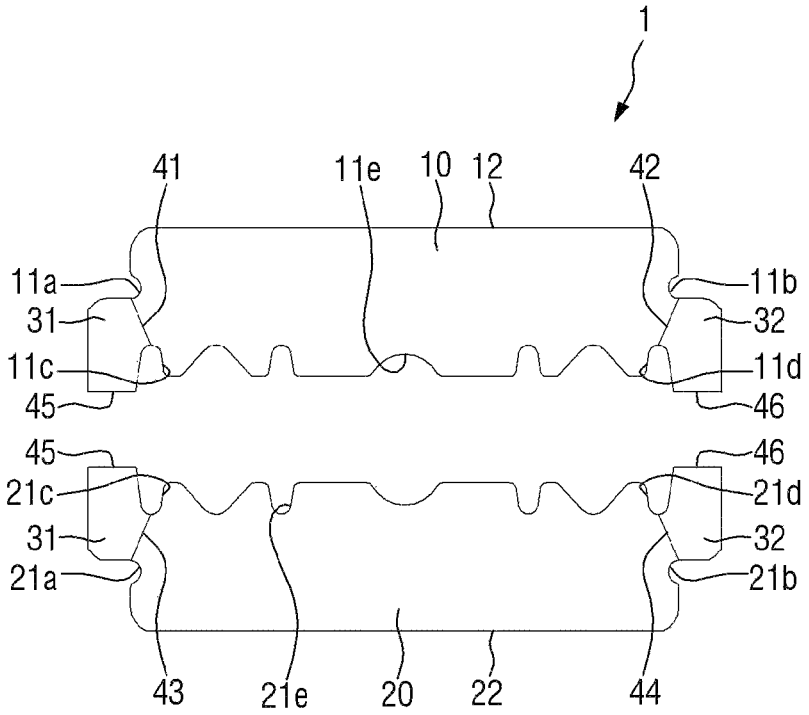

【FIG. 4】
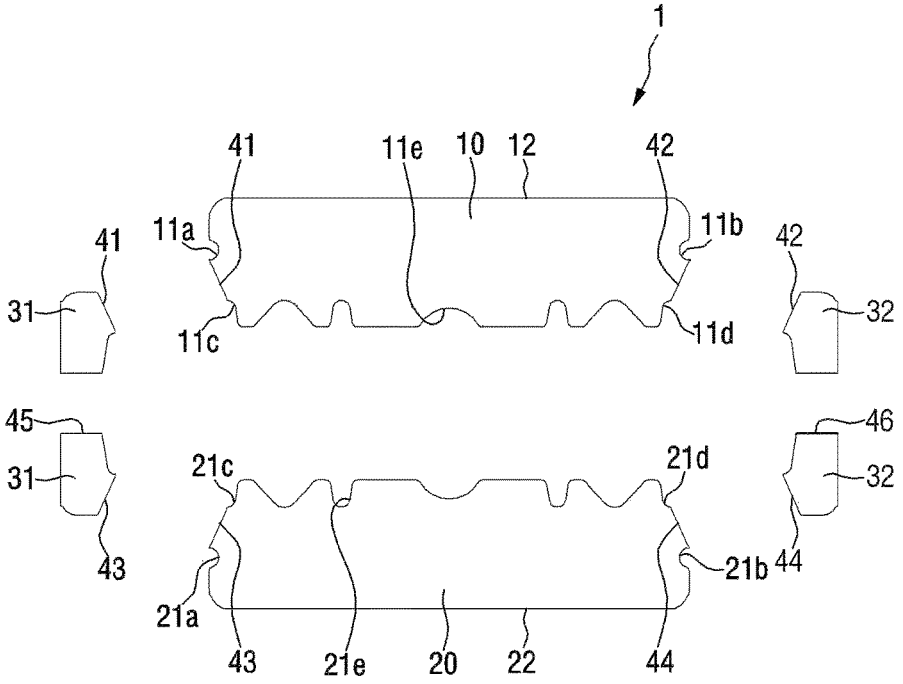

【FIG. 5】
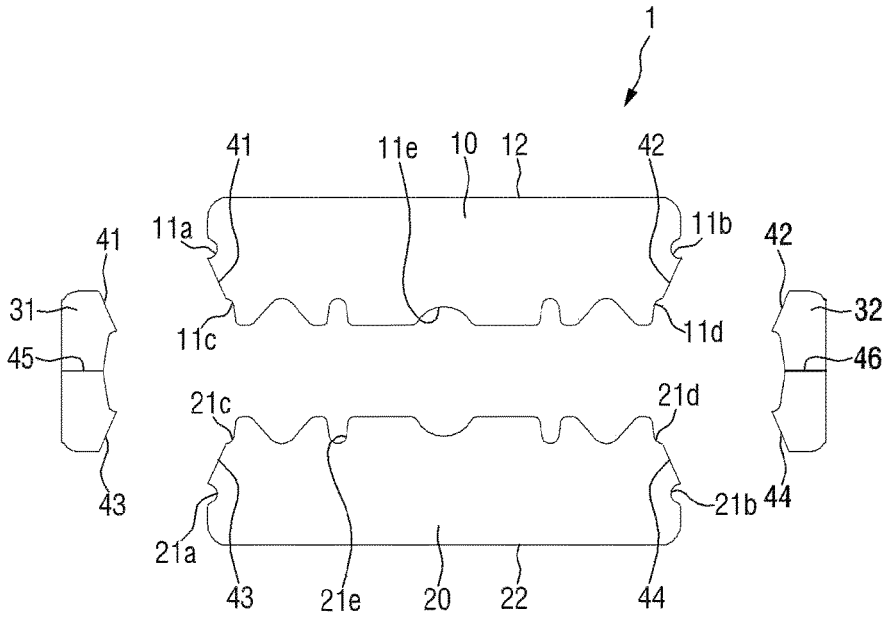
【FIG. 6】
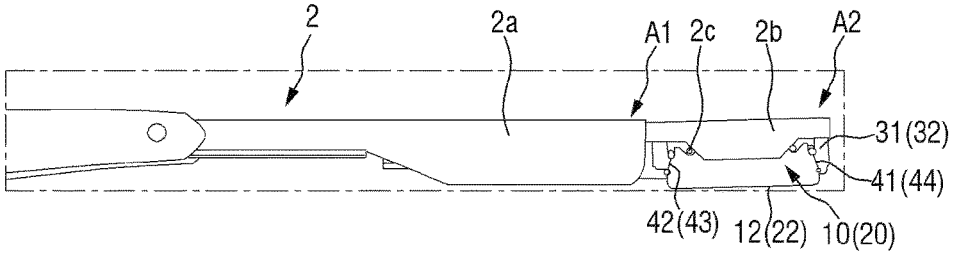

【FIG. 7】
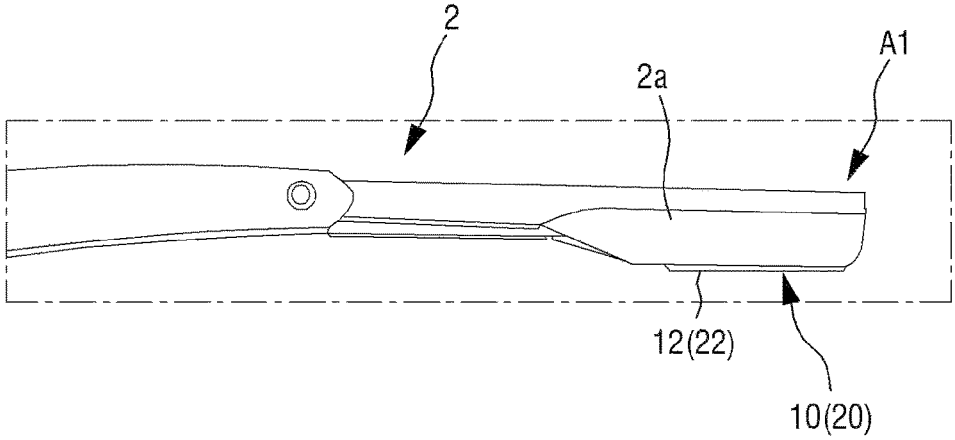
【FIG. 8】
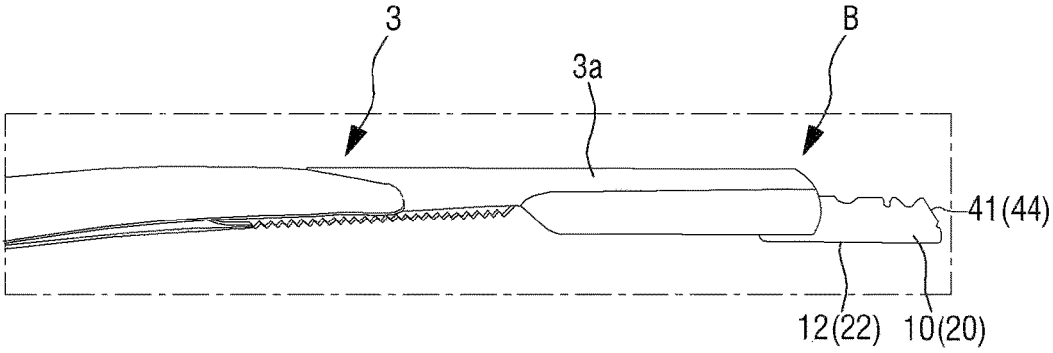

【FIG. 9】
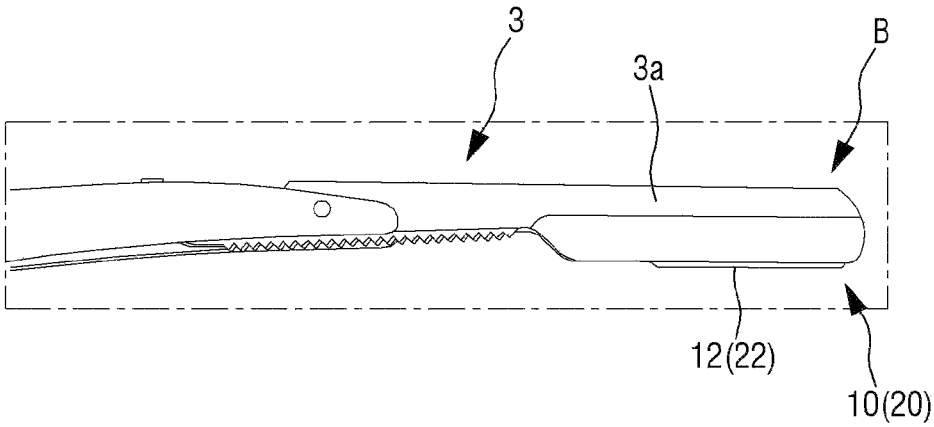

SNAP-OFF DOUBLE-EDGED RAZOR BLADE

CROSS-REFERENCE

This application is a continuation application of international application PCT/KR2015/012693, filed on Nov. 25, 2015, now pending, which claims foreign priority from Korean Patent Application No. 10-2015-0130046 filed on Sep. 15, 2015 in the Korean Intellectual Property Office, the disclosure of each document is incorporated herein by reference in their entirety.

TECHNICAL FIELD

The present disclosure relates to a double-edged razor blade, and more particularly to a double-edged razor blade that can be split into two more than pieces for use.

BACKGROUND

A double-edged razor blade with cutting edges formed on its both sides is inserted into a separate holder for a user's safety when it is used.

Double-edged razor blades may be used as disclosed in Korean Utility Model Publication Nos. 1990-0004391 and 1984-000958. Also, double-edged razor blades may be used as disclosed in Korean Utility Model Publication No. 1990-0001105, i.e., a double-edged razor blade is split into two pieces to be inserted into a holder (razor).

RELATED ART DOCUMENT

Patent Document (Document 1) Korean Utility Model Publication No. 1990-0004391

(Document 2) Korean Utility Model Publication No. 1984-000958

(Document 3) Korean Utility Model Publication No. 1990-0001105

SUMMARY

Exemplary embodiments of the present disclosure provide a double-edged razor blade that can be easily split into a desired shape for use.

It should be noted that objects of the present invention are not limited to the above-mentioned object; and other objects of the present invention will be apparent to those skilled in the art from the following descriptions.

In accordance with an aspect of the present disclosure, A double-edged razor blade, comprising: a first unit blade having a first cutting edge; a second unit blade having a second cutting edge; a first connecting portion connecting one side of the first unit blade with one side of the second unit blade; a second connecting portion connecting the other side of the first unit blade with the other side of the second unit blade; a pair of first notches forming a boundary between the first unit blade and the first and the second connecting portions, and guiding breakage of the first unit blade; and a pair of second notches forming a boundary between the second unit blade and the first and the second connecting portions, guiding breakage of the second unit blade.

Each notch of the pair of first notches forms an acute angle with the first cutting edge, and each notch of the pair of second notches forms an acute angle with the second cutting edge.

The acute angle formed by each notch of the pair of first notches with the first cutting edge ranges from 60 to 80 degrees, and the acute angle formed by each notch of the pair of second notches with the second cutting edge ranges from 60 to 80 degrees.

The first unit blade comprises first concave portions formed to be in contact with both ends of each of the first notches, and the second unit blade comprises second concave portions formed to be in contact with both ends of each of the second notches.

At least one of the first pair of notches and the second pair of notches comprise a groove having a V-shaped cross-section.

The razor blade may further comprise: a pair of third notches formed to traverse the first connecting portion and the second connecting portion to guide breakage of the first connecting portion and the second connecting portion.

The first unit blade and the second unit blade are substantially symmetric to each other with respect to the pair of third notches.

The pair of third notches comprise a groove having a V-shaped cross-section.

Other particulars of the present disclosure will be described in the detailed description with reference to the accompanying drawings.

According to exemplary embodiments of the present disclosure, at least following effect can be achieved:

A double-edged razor blade can be easily split into a desired shape.

It should be noted that effects of the present disclosure are not limited to those described above and other effects of the present disclosure are included following descriptions.

BRIEF DESCRIPTION OF DRAWINGS

FIG. 1 is a view showing a double-edged blade according to an exemplary embodiment of the present disclosure;

FIG. 2 is a cross-sectional view showing a notch of the double-edged blade according to the exemplary embodiment of the present disclosure;

FIG. 3 is a view showing the double-edged blade split along the third notches according to the exemplary embodiment of the present disclosure;

FIG. 4 is a view showing the double-edged blade of FIG. 3 after it is further split along the first and second notches;

FIG. 5 is a view showing the double-edged blade split along the first and second notches according to the exemplary embodiment of the present disclosure;

FIGS. 6 and 7 are views for illustrating an example of using a unit blade of the double-edged blade split into the shape shown in FIG. 3; and FIGS. 8 and 9 are views for illustrating examples of using the unit blade of the double-edged blade split into the shape shown in FIG. 4 or 5.

DESCRIPTION OF EMBODIMENTS

Advantages and features of the present disclosure and methods to achieve them will become apparent from the descriptions of exemplary embodiments hereinbelow with reference to the accompanying drawings. However, the present invention is not limited to exemplary embodiments disclosed herein but may be implemented in various different ways. The exemplary embodiments are provided for making the disclosure of the present invention thorough and for fully conveying the scope of the present invention to those skilled in the art. It to be noted that the scope of the present invention is defined only by the claims. Like reference numerals denote like elements throughout the descriptions.

Embodiments of the inventive subject matter are described herein with reference to plan and perspective illustrations that are schematic illustrations of idealized embodiments of the inventive subject matter. As such, variations from the shapes of the illustrations as a result, for example, of manufacturing techniques and/or tolerances, are to be expected. The figures are not necessarily drawn to scale, and in some instances the drawings have been exaggerated and/or simplified in places for illustrative purposes only. Like reference numerals denote like elements throughout the descriptions.

Hereinafter, a snap-off double-edged razor blade (hereinafter referred to as a double-edged blade) according to an exemplary embodiment of the present disclosure will be described below.

FIG. 1 is a view showing a double-edged blade according to an exemplary embodiment of the present disclosure. FIG. 2 is a cross-sectional view showing a notch of the double-edged blade according to the exemplary embodiment of the present disclosure. As shown in FIG. 1, a double-edged blade 1 according to an exemplary embodiment of the present disclosure includes a first unit blade 10 having a first cutting edge 12 formed thereon, and a second unit blade 20 having a second cutting edge 22 formed thereon.

The first unit blade 10 and the second unit blade 20 have a shape symmetrical to each other, and the first cutting edge 12 and the second cutting edge 22 face outward.

A first connecting portion 31 connects one side of the first unit blade 10 and one side of the second unit blade 20. A second connecting portion 32 connects the other side of the first unit blade 10 and the other side of the second unit blade 20. The first unit blade 10, the second unit blade 20, the first connecting portion 31 and the second connecting portion 32 may be formed as a signal piece.

The double-edged blade 1 according to the exemplary embodiment of the present disclosure is formed of metal materials, preferably, stainless steels. For example, a material consisting of C (0.62 to 0.70 wt %), Si (0.15 to 0.50 wt %), Mn (0.25 to 0.80 wt %), P (0 to 0.025 wt %), S (0 to 0.020 wt %), Cr (12.7 to 13.7 wt %), Ni (0 to 0.50 wt %), and Fe (the rest) may be used. It is, however, to be understood that the material of the double-edged blade 1 is not limited to metal materials but may be formed of materials that can be sharpened such as ceramics.

The thickness of the double-edged blade 1 according to the exemplary embodiment of the present disclosure may range from 0.05 mm to 2 mm, and more preferably 0.075 mm to 0.1 mm.

The horizontal width of the double-edged blade 1 according to the exemplary embodiment of the present disclosure may range from 30 mm to 50 mm, and the vertical width may range from 10 mm to 30 mm. The horizontal width refers to the length from the first connecting portion 31 to the second connecting portion 32. The vertical width refers to the distance from the first cutting edge 12 to the second cutting edge 22.

The composition ratio, thickness, horizontal width and vertical width are merely examples of the double-edged blade 1 according to an exemplary embodiment of the present disclosure, and the present disclosure is not limited thereto.

As shown in FIG. 1, the first connecting portion 31 and the second connecting portion 32 support the first unit blade 10 and the second unit blade 20 such that they are apart from each other. Accordingly, as shown in FIG. 1, the double-edged blade 1 according to the exemplary embodiment of the present disclosure has a hole surrounded by the first unit blade 10, the second unit blade 20, the first connecting portion 31 and the second connecting portion 32 at a center portion.

As shown in FIG. 1, a number of first concave portions 11*a*, 11*b*, 11*c*, 11*d* and 11*e* are formed on one side, the other side, and the side opposite to the first cutting edge 12 of the first unit blade 10. Likewise, a number of second concave portions 21*a*, 21*b*, 21*c*, 21*d* and 21*e* are formed on one side, the other side, and the side opposite to the second cutting edge 22 of the second unit blade 20.

The number of first concave portions 11*a*, 11*b*, 11*c*, 11*d* and 11*e* and the number of second concave portions 21*a*, 21*b*, 21*c*, 21*d* and 21*e* may be formed to correspond to a number of protrusions 2C formed on a razor 2 (see FIG. 6) in which the double-edged blade 1 is mounted.

The protrusions 2*c* may be engaged with the first concave portions 11*a*, 11*b*, 11*c*, 11*d* and 11*e* or the second concave portions 21*a*, 21*b*, 21*c*, 21*d* and 21*e* when the first unit blade 10 or the second unit blade 20 is fed into the razor 2, to fix the first unit blade 10 or the second unit blade 20 or determine the location where it is mounted.

On the other hand, a pair of first notches 41 and 42 are formed on both sides of the first unit blade 10, respectively.

The first notch 41 on one side of the pair of first notches 41 and 42 forms a boundary between the first unit blade 10 and the first connecting portion 31, while the first notch 42 on the other side forms a boundary between the first unit blade 10 and the second connecting portion 32. The first notch 41 on the one side guides the breakage between the first unit blade 10 and the first connecting portion 31 along it, while the first notch 42 on the other side guides the breakage between the first unit blade 10 and the second connecting portion 32 along it.

As shown in FIG. 1, the pair of first notches 41 and 42 are formed at an acute angle with the first cutting edge 12, respectively.

Specifically, in FIG. 1, an angle formed by an imaginary line extending upward from the first notch 41 on the one side and an imaginary line extending to the left hand from the first cutting edge 12 is an acute angle. An angle formed by an imaginary line extending upward from the first notch 42 on the other side and an imaginary line extending to the right hand from the first cutting edge 12 is an acute angle.

The angle formed by each of the first notches 41 and 42 with the first cutting edge 12 may range from 60 to 80 degrees, and more preferably from 65 to 75 degrees.

Similarly, a pair of second notches 43 and 44 are formed on both sides of the second unit blade 20, respectively.

The second notch 43 on one side of the pair of second notches 43 and 44 forms a boundary between the second unit blade 20 and the first connecting portion 31, while the second notch 44 on the other side forms a boundary between the second unit blade 20 and the second connecting portion 32.

The second notch 43 on the one side guides the breakage between the second unit blade 20 and the first connecting portion 31 along it, while the second notch 44 on the other side guides the breakage between the second unit blade 20 and the second connecting portion 32 along it.

As shown in FIG. 1, the pair of second notches 43 and 44 are formed at an acute angle with the second cutting edge 22, respectively.

Specifically, in FIG. 1, an angle formed by an imaginary line extending downward from the second notch 43 on the one side and an imaginary line extending to the left hand from the second cutting edge 22 is an acute angle. An angle formed by an imaginary line extending downward from the second notch 44 on the other side and an imaginary line extending to the right hand from the second cutting edge 22 is an acute angle.

The angle formed by each of the second notches 43 and 44 with the second cutting edge 22 may range from 60 to 80 degrees, and more preferably from 65 to 75 degrees.

As shown in FIG. 1, a pair of third notches 45 and 46 are formed in the first connecting portion 31 and the second connecting portion 32.

The pair of third notches 45 and 46 are formed on an imaginary line equally dividing the double-edged blade 1. The first unit blade 10 is positioned on one side of the imaginary line and the second unit blade 20 is positioned on the other side of the imaginary line. The first unit blade 10 and the second unit blade 20 are symmetric to each other with respect to the imaginary line and the pair of third notches 45 and 46.

The third notch 45 formed in the first connecting portion 31 of the pair of third notches 45, guides the first connecting portion 31 to be split into two pieces, and the third notch 46 formed in the second connecting portion 32 guides the second connecting portion 32 to be split into two pieces.

The pair of third notches 45 and 46 may be eliminated in some implementations.

FIG. 2 shows one of the first notches 41 and 42, the second notches 43 and 44 and the third notches 45 and 46. In the following description, the notch shown in FIG. 2 is assumed as the first notches 41 and 42 for convenience of illustration.

As shown in FIG. 2, the first notches 41 and 42 may be formed as V-shaped grooves having a generally triangular cross section. The V-shaped groove may be composed of a first oblique surface 41*a* and a second oblique surface 41*b* which form a line of intersection.

The force required to separate the first unit blade 10 from the first connecting portion 31 along the first notches 41 and 42 is determined depending on a width w and a depth d of the first notches 41 and 42 or an angle θ formed by the first oblique surface 41*a* and the second oblique surface 41*b*. The angle θ may be determined depending on the width w and the depth d.

If the depth d of the first notches 41 and 42 is too shallow relative to the thickness of the double-edged blade 1 (e.g., less than 5% of the thickness), too much force may be required to split along the first notches 41 and 42, or the first unit blade 10 and the first connecting portion 31 may fail to be split along the first notches 41 and 42 even if they are split.

On the contrary, if the depth d of the first notches 41 and 42 is too deep relative to the thickness of the double-edged blade 1 (for example, more than 50% of the thickness), the force required to split the double-edged blade 1 along the first notches 41 and 42 may be reduced, but the double-edged blade 1 may be unintentionally split in use or may be unintentionally split by a force applied during delivery or storage.

The optimal depth d of the first notches 41 and 42 may vary depending on the material of the double-edged razor blade 1. It is known from experiments that the double-edged blade 1 can be split best if the depth is approximately 10% of the thickness.

The depth d of the notches 41, 42, 43, 44, 45 and 46 may range from 5% to 50% relative to the thickness of the double-edged blade 1, depending on the design specifications of the double-edged blade 1. The depths d of the first notches 41 and 42, the second notches 43 and 44 and the third notches 45 and 46 may be different from one another. The angle θ may range from 45 to 130 degrees, and more preferably, approximately 90 degrees.

Although FIG. 2 shows a V-shaped groove as an example of the notches, the first notches 41 and 42, the second notches 43 and 44 or the third notches 45 and 46 may have different shapes as long as stress can be concentrated.

FIG. 3 is a view showing the double-edged blade split along the third notches according to the exemplary embodiment of the present disclosure. FIG. 4 is a view showing the double-edged blade of FIG. 3 after it is further split along the first and second notches. FIG. 5 is a view showing the double-edged blade split along the first and second notches according to the exemplary embodiment of the present disclosure.

When a force is applied to each of the third notches 45 and 46, stress is concentrated on the third notches 45 and 46 so that the first connecting portion 31 and the second connecting portion 32 are split along the third notches 45 and 46, respectively.

As a result, as shown in FIG. 3, the double-edged blade 1 is split along the third notches 45 and 46 into two pieces, i.e., the first unit blade 10 and the second unit blade 20.

Alternatively, to split the double-edged blade 1 into the shape shown in FIG. 4, first, the double-edged blade 1 is split along the third notches 45 and 46 to have the shape as shown in FIG. 3, and then is split along the first notches 41 and 42 and the second notches 43 and 44, such that the first unit blade 10 and the second unit 20 from which the first connecting portion 31 and the second connecting portion 32 are removed may be prepared.

Alternatively, in another exemplary embodiment where which no third notches 45 and 46 are formed, the center portions of the first connecting portion 31 and the second connecting portion 32 are broken by bending them once or more, and then is split along the first notches 41 and 42 and the second notches 43 and 44, such that the first unit blade 10 and the second unit 20 from which the first connecting portion 31 and the second connecting portion 32 are removed may be prepared.

In addition, to prepare the first unit blade 10 and the second unit blade 20 from which the first connecting portion 31 and the second connecting portion 32 are removed, the double-edged blade 1 may be split as shown in FIG. 5.

Specifically, when a force is applied to each of the first notches 41 and 42, stress is concentrated on the first notches 41 and 42 so that the first unit blade 10, the first connecting portion 31 and the second connecting portion 32 may be split along the first notches 41 and 42. As a result, as shown in FIG. 5, the first unit blade 10 is broken away from the double-edged blade 1 along the first notches 41 and 42.

To concentrate stress more efficiently, as shown in FIGS. 1 and 5, both ends of the first notch 41 on one side are in contact with the first concave portions 11*a* and 11*c* on the side, respectively, which are closer to the one side than others among the first concave portions 11*a*, 11*b*, 11*c*, 11*d* and 11*e*, while both ends of the first notch 42 on the other side are in contact with the first concave portions 11*b* and 11*d* on the other side, respectively, which are closer to the other side than others among the first concave portions 11*a*, 11*b*, 11*c*, 11*d* and 11*e*.

In addition, when a force is applied to each of the second notches 43 and 44, stress is concentrated on the second notches 43 and 44 so that the second unit blade 20, the first connecting portion 31 and the second connecting portion 32 may be split along the second notches 43 and 44. As a result, as shown in FIG. 5, the second unit blade 20 is broken away from the double-edged blade 1 along the second notches 43 and 44.

To concentrate stress more efficiently, as shown in FIGS. 1 and 5, both ends of the second notch 43 on one side are in contact with the second concave portions 21*a* and 21*c* on the side, respectively, which are closer to the one side than others among the second concave portions 21*a*, 21*b*, 21*c*, 21*d* and 21*e*, while both ends of the second notch 44 on the other side are in contact with the second concave portions 21*b* and 21*d* on the other side, respectively, which are closer to the other side than others among the second concave portions 21*a*, 21*b*, 21*c*, 21*d* and 21*e*.

As shown in FIG. 5, the thickness d of the third notches 45 and 46 may be thicker than the thicknesses d of the first notches 41 and 42 and the second notches 43 and 44 so that the first notches 41 and 42 and the second notches 43 and 44 are broken first whereas the third notches 45 and 46 are not broken.

Alternatively, even if the thickness d of the first notches 41 and 42, the second notches 43 and 44 and the third notches 45 and 46 are equal, the same effect can be achieved by setting angles of the first notches 41 and 42 and the second notches 43 and 44.

Alternatively, when the double-edged blade is split as shown in FIG. 5, the third notches 45 and 46 are not necessary and thus the third notches 45 and 46 may be eliminated so that the double-edged blade is more effectively split along the first notches 41 and 42 and the second notches 43 and 44.

As described above, the double-edged blade 1 according to the exemplary embodiment of the present disclosure includes the three pairs of notches 41 and 42, 43 and 44, and 45 and 46, so that a user can split the double-edged blade 1 as she/he desires, to use the first unit blade 10 and the second unit blade 20 separately.

For example, if a user wants to split the double-edged blade into the shape shown in FIG. 3, the double-edged blade 1 may be split along the third notches 45 and 46. When the user wants to split the double-edged blade into the shape shown in FIG. 4 or 5, the double-edged blade 1 may be split along the first notches 41 and 42 and the second notches 43 and 44.

FIGS. 6 and 7 are views for illustrating an example of using a unit blade of the double-edged blade split into the shape shown in FIG. 3.

As shown in FIG. 6, a razor 2 may include an inner blade housing 2*b* and an outer blade housing 2*a*. A plurality of protrusions 2*c* is formed in the inner blade housing 2*b*, which is engaged with the concave portions 11*a*, 11*b*, 11*c*, 11*d* and 11*e* or 21*a*, 21*b*, 21*c*, 21*d* and 21*e* of the unit blade 10 or 20 so that the unit blade 10 or 20 is fixed to the inner blade housing 2*b*.

In order to firmly couple the protrusions 2*c* with the concave portions 11*a*, 11*b*, 11*c*, 11*d* and 11*e* or 21*a*, 21*b*, 21*c*, 21*d* and 21*e*, the unit blade 10 or 20 has to be coupled with the inner blade housing 2*b* with a part of the first connecting portion 31 and the second connecting portion 32 existing on both sides of the unit blade 10 or 20. This is because the concave portions 11*a*, 11*b*, 11*c*, 11*d* or 21*a*, 21*b*, 21*c*, 21*d* closer to the other side than the others among the concave portions 11*a*, 11*b*, 11*c*, 11*d*, 11*e* or 21*a*, 21*b*, 21*c*, 21*d*, 21*e* hold the protrusions 2*c* together with the first connecting portion 31 or the second connecting portion 32 of the unit blade 10 or 20.

Therefore, it is desired that the razor 2 of the type shown in FIG. 6 is fed with the unit blade 10 or 20 of the double-edged blade split along the third notches 45 and 46 into the shape shown in FIG. 3.

In order to accommodate the unit blade 10 or 20 including the part of the first connecting portion 31 or the second connecting portion 32 split along the third notches 45 and 46, the front upper ends A1 and A2 of the inner blade housing 2*b* and the outer blade housing 2*a* have an outline substantially at right angles.

As shown in FIG. 6, the unit blade 10 or 20 split along the third notches 45 and 46 is placed in the inner blade housing 2*b*, and then slides into the outer blade housing 2*a* to be mounted in the razor 2 as shown in FIG. 7.

FIGS. 8 and 9 are views for illustrating examples of using the unit blade of the double-edged blade split into the shape shown in FIG. 4 or 5.

As shown in FIG. 8, a razor 3 may include a blade housing 3*a* that fixes the unit blade 10 or 20.

The upper end B of the blade housing 3*a* of the razor 3 shown in FIG. 8 has a curved outline toward the rear side, unlike the razor 2 shown in FIGS. 6 and 7. Therefore, if the unit blade 10 or 20 broken away along the third notches 45 and 46 is inserted as shown in FIG. 3, a part of the first connecting portion 31 or the second connecting portion 32 may be exposed out of the front upper end B of the blade housing 3*a*.

Accordingly, when the double-edged blade 1 is used for the razor 3 shown in FIG. 8, the unit blade 10 or 20 of the double-edged blade 1 that is split along the first notches 41 and 42 or the second notches 43 and 44 has to be inserted, as shown in FIG. 8.

As shown in FIG. 8, the unit blade 10 or 20 of the double-edged blade 1 split along the first notches 41 and 42 or the second notches 43 and 44 may slide from the front end of the blade housing 3*a*, and may be mounted in the razor 3 as shown in FIG. 8.

Since the unit blade 10 or 20 is broken away along the first notches 41 and 42 or the second notches 43 and 44, only the cutting edge 12 or 22 is exposed out of the blade housing 3*a*.

As described above, since the double-edged blade 1 according to the exemplary embodiment of the present disclosure has the notches 41, 42, 43, 44, 45 and 46 formed thereon for guiding the breakage, it is easy to split the double-edged blade 1 into a desired shape for use.

In addition, the double-edged blade 1 according to the exemplary embodiment of the present disclosure includes the three pairs of notches 41 and 42, 43 and 44, and 45 and 46, so that a user can split the double-edged blade 1 into a shape appropriate for a razor 2 or 3, to use the first unit blade 10 and the second unit blade 20 separately.

It will be evident to those skilled in the art that various modifications and changes may be made in the exemplary embodiments of the present disclosure without departing from the technical idea or the gist of the present disclosure. Therefore, it should be understood that the above-mentioned embodiments are not limiting but illustrative in all aspects. It should be appreciated that the scope of the present invention is defined by the following claims rather than the above-mentioned detailed descriptions and all modifications or alterations deduced from the meaning, the scope, and equivalences of the claims are to be construed as falling within the scope of the present invention.

A double-edged razor blade, comprising: a first unit blade having a first cutting edge; a second unit blade having a second cutting edge; a first connecting portion connecting one side of the first unit blade with one side of the second unit blade; a second connecting portion connecting the other side of the first unit blade with the other side of the second unit blade; a pair of first notches forming a boundary between the first unit blade and the first and the second connecting portions, and guiding breakage of the first unit blade; and a pair of second notches forming a boundary between the second unit blade and the first and the second connecting portions, guiding breakage of the second unit blade.

What is claimed is:

1. A double-edged razor blade, comprising:

a first unit blade having a first cutting edge;

a second unit blade having a second cutting edge;

a first connecting portion connecting one side of the first unit blade with one side of the second unit blade;

a second connecting portion connecting the other side of the first unit blade with the other side of the second unit blade;

a pair of first notches forming a boundary between the first unit blade and the first and the second connecting portions, and guiding breakage of the first unit blade, wherein a direction along which each notch of the pair of first notches extends forms an acute angle with a direction along which the first cutting edge extends; and a pair of second notches forming a boundary between the second unit blade and the first and the second connecting portions, guiding breakage of the second unit blade, wherein a direction along which each notch of the pair of second notches extends forms an acute angle with a direction along which the second cutting edge extends.

2. The double-edged razor blade of claim 1, wherein the acute angle formed by each notch of the pair of first notches with the first cutting edge ranges from 60 to 80 degrees, and the acute angle formed by each notch of the pair of second notches with the second cutting edge ranges from 60 to 80 degrees.

3. The double-edged razor blade of claim 1, wherein the first unit blade comprises first concave portions formed to be in contact with both ends of each of the first notches, and the second unit blade comprises second concave portions formed to be in contact with both ends of each of the second notches.

4. The double-edged razor blade of claim 1, wherein at least one of the first pair of notches and the second pair of notches comprise a groove having a V-shaped cross-section.

5. The double-edged razor blade of claim 1, further comprising: a pair of third notches formed to traverse the first connecting portion and the second connecting portion to guide breakage of the first connecting portion and the second connecting portion.

6. The double-edged razor blade of claim 5, wherein the first unit blade and the second unit blade are substantially symmetric to each other with respect to the pair of third notches.

7. The double-edged razor blade of claim 5, wherein the pair of third notches comprise a groove having a V-shaped cross-section.

* * * * *